US006851312B2

(12) United States Patent
Rosenbauer et al.

(10) Patent No.: US 6,851,312 B2
(45) Date of Patent: Feb. 8, 2005

(54) WATER-BEARING HOUSEHOLD APPLIANCE

(75) Inventors: Michael Rosenbauer, Reimlingen (DE); Bruno Reiter, Neresheim-Kösingen (DE); Reinhard Hering, Holzheim (DE); Michael Weisskopf, Bopfingen (DE); Peter Schweier, Forheim (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/105,840

(22) Filed: Mar. 25, 2002

(65) Prior Publication Data

US 2003/0010113 A1 Jan. 16, 2003

Related U.S. Application Data

(63) Continuation of application No. PCT/EP00/08758, filed on Sep. 7, 2000.

(30) Foreign Application Priority Data

Sep. 24, 1999 (DE) ..... 199 45 925

(51) Int. Cl.[7] ..... G01F 23/292
(52) U.S. Cl. ..... 73/290 R; 73/293; 73/302
(58) Field of Search ..... 73/290 R, 293, 73/302, 305, 313

(56) References Cited

U.S. PATENT DOCUMENTS 4,713,552 A * 12/1987 Denis et al. ..... 250/577
4,906,845 A * 3/1990 Bellhouse et al. ..... 250/227.28
5,265,446 A 11/1993 Kuroda et al. ..... 68/12.02
5,729,025 A * 3/1998 Erickson et al. ..... 250/574
5,731,868 A * 3/1998 Okey et al. ..... 356/73
5,803,985 A * 9/1998 Alvord ..... 134/18
5,874,899 A * 2/1999 Barmore, Jr. et al. ..... 340/623
6,057,772 A * 5/2000 Burkett ..... 340/612

FOREIGN PATENT DOCUMENTS

| | | | | |
|---|---|---|---|---|
| DE | 36 44 013 A1 | | 6/1988 | |
| DE | 38 21 306 A1 | | 12/1989 | |
| DE | 42 20 718 C2 | | 2/1993 | |
| DE | 41 40 949 A1 | | 6/1993 | |
| DE | 43 03 250 A1 | | 8/1993 | |
| DE | 43 41 232 A1 | | 6/1995 | |
| DE | 43 42 272 A1 | | 6/1995 | |
| DE | 195 28 322 A1 | | 2/1997 | |
| EP | 0 546 434 B1 | | 6/1993 | |
| GB | 2 123 148 A | | 1/1984 | |
| GB | 2123148 | * | 1/1984 | ..... G05D/9/02 |

* cited by examiner

*Primary Examiner*—Hezron Williams
*Assistant Examiner*—Rodney Frank
(74) *Attorney, Agent, or Firm*—Laurence A. Greenberg; Werner H. Stemer; Gregory L. Mayback

(57) ABSTRACT

In a water-bearing household appliance with a liquid container filled through a valve in a liquid feed line, and in which a liquid filling level is detected for monitoring at least one safety level of a safety device, the safety device includes an optical light guidance system for reflecting a light beam by which the filling level is detected with the aid of a change in the reflection response on at least one reflecting site and is used to monitor the safety level. As an optical light guidance system, the safety device offers the advantage of dispensing with moving mechanical components—for example, a float, a level switch, an operating lever, an operating rod, etc.—to reduce the risk of mechanical defects that are associated with a substantial outlay on repair time and costs to a minimum or to completely eliminate the risk.

16 Claims, 1 Drawing Sheet

WATER-BEARING HOUSEHOLD APPLIANCE

CROSS-REFERENCE TO RELATED APPLICATION

This application is a continuation of copending International Application No. PCT/EP00/08758, filed Sep. 7, 2000, which designated the United States.

BACKGROUND OF THE INVENTION

Field of the Invention

The invention relates to a water-bearing household appliance with a container for liquid that can be filled through a valve disposed in a liquid feed line, and in which a filling level of the liquid can be detected for the purpose of monitoring at least one safety level of a safety device.

Conventional water-bearing household appliances—for example dishwashers—have a safety device for monitoring a safety level in a container filled with liquid. The filling level of the liquid is detected for such a purpose. A controllable valve disposed in a liquid feed line fills the container. For example, German Patent DE 42 20 718 C2 discloses a water-bearing household appliance whose safety device has level sensors associated with a plurality of containers. These level sensors are constructed as floats that are disposed below one another and can actuate a switch independently of one another by moving an operating rod. As such, the filling level is detected purely mechanically, something that signifies a substantial outlay on movable components, and, thus, an increased risk of mechanical defects.

SUMMARY OF THE INVENTION

It is accordingly an object of the invention to provide a water-bearing household appliance that overcomes the hereinafore-mentioned disadvantages of the heretofore-known devices of this general type and that improves upon such prior art appliances.

With the foregoing and other objects in view, there is provided, in accordance with the invention, a water-bearing household appliance, including a valve, a liquid feed line connected to the valve, a container connected to the liquid feed line, the container filled with liquid through the valve and the liquid feed line to a liquid filling level, a safety device connected to the container and having at least one safety level and an optical light guidance system having at least one reflecting site and reflecting a light beam on the at least one reflecting site, and the light guidance system detecting the liquid filling level in the container by a change in a reflection response of the light beam at the at least one reflecting site and monitoring the at least one safety level utilizing the change in the reflection response. The light guidance system can be programmed to detect the liquid filling level in the container by a change in a reflection response of the light beam at the at least one reflecting site and to monitor the at least one safety level utilizing the change in the reflection response.

Starting from a water-bearing household appliance with a container for liquid that can be filled through a valve disposed in a liquid feed line, and in which a filling level of the liquid can be detected for the purpose of monitoring at least one safety level of a safety device, the invention provides a safety device configured as an optical light guidance system for reflecting a light beam by which the filling level is detected with the aid of a change in the reflection response at one or more reflecting sites and is used to monitor the safety level.

The safety device according to the invention offers the advantage of making it possible to dispense with moving mechanical components—for example, a float, a level switch, an operating lever, an operating rod, etc.—such that the risk of mechanical defects that are associated with a substantial outlay on repair time and costs is reduced to a minimum or is completely eliminated. Moreover, the optical safety device can be fabricated more easily and be mounted in water-bearing household appliances more easily than mechanical devices. By the optical light guidance system, the invention also advantageously supports electronic evaluation of the detection and monitoring of one or more safety levels.

In accordance with another feature of the invention, it has proved to be favorable that the detection of the filling level is used to monitor a double safety level for overfilling and emptying of the container. Therefore, two safety levels can be monitored reliably and elegantly at the same time by the same safety device, the optical light guidance system.

In accordance with a further feature of the invention, the detection of the filling level is additionally used to monitor at least one prescribable filling height. Consequently, in addition to the safety level, it is also possible to monitor an individual filling height reliably and elegantly with the aid of one and the same safety device, the optical light guidance system. The separated detection and monitoring of the double safety level and of a filling height is possible with the aid of an optical device owing to a single safety device.

In accordance with an added feature of the invention, the optical light guidance system preferably has an immersion rod and at least one prismatic reflection member for monitoring a double safety level. Due to the reflection member, the light beam can be coupled into the optical light guidance system with particular ease and be used with the aid of the reflection response at one or more sites, taking account of the various refractive indexes of the liquid present in the container of the household appliance—preferably water—and the air to detect the filling level for the purpose of monitoring the safety level. Preferably disposed in the prismatic reflection member is a prismatic member, by which the light beam is deflected into the immersion rod and back from there to the reflection member. Thereby, it is possible to influence the path of the light beam with particular ease and a low outlay in order chiefly to monitor the double safety level.

In accordance with an additional feature of the invention, the optical light guidance system has a prismatic reflection member for monitoring the filling height. Consequently, it is possible to dispose chiefly a plurality of reflection members advantageously in one and the same light guidance system for different monitoring purposes. Each prismatic reflection member is permanently connected to the immersion rod to form a safety device that is as compact as possible.

In accordance with yet another feature of the invention, it is particularly favorable when an optical sensor for coupling the light beam into the light guidance system and for coupling the light beam out of the light guidance system is fitted on each prismatic reflection member. Consequently, the initiation and evaluation of the monitoring function for safety level(s) and filling height can be performed completely independently of one another for the reflection members. Mutual influence is thereby as good as ruled out.

In accordance with yet a further feature of the invention, the at least one prismatic reflection member is a plurality of reflection members and an optical sensor is disposed on each of the reflection members, the optical sensor coupling the light beam into the light guidance system and out of the light guidance system.

In accordance with yet an added feature of the invention, the optical light guidance system is coupled—preferably under processor control—to an electronic evaluation device that initiates at least one safety measure upon reception of at least one monitoring signal from the light guidance system. The evaluation of incoming monitoring signals—for example, by a microprocessor—from an optical system permits an intelligent direct reaction of the household appliance to possible problems with the level. High-quality household appliances mostly have a processor control in any case, and so the above method does not even require an additional device—rather it is merely necessary to adapt the already existing processor control with software.

In accordance with yet an additional feature of the invention, the electronic evaluation device is coupled to the valve and the at least one safety measure is a switching off of the valve.

In accordance with again another feature of the invention, there is provided a suds pump connected to the container for exhausting liquid from the container, the at least one safety measure being a switching on of the suds pump to exhaust liquid from the container.

In accordance with again a further feature of the invention, there is provided a master switch, the at least one safety measure being a switching off of the master switch.

In accordance with again an added feature of the invention, the light guidance system is of a transparent material.

In accordance with again an additional feature of the invention, the container has a plurality of contact sites and the light guidance system is connected to at least one of the contact sites. Preferably, the light guidance system is connected to each of the contact sites.

With the objects of the invention in view, in a water-bearing household appliance with a liquid container filled through a valve disposed in a liquid feed line there is also provided a safety device including at least one safety level and an optical light guidance system having at least one reflecting site and reflecting a light beam on the at least one reflecting site, the light guidance system detecting a liquid filling level in the container by a change in a reflection response of the light beam at the at least one reflecting site and monitoring the at least one safety level utilizing the change in the reflection response.

Other features that are considered as characteristic for the invention are set forth in the appended claims.

Although the invention is illustrated and described herein as embodied in a water-bearing household appliance, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
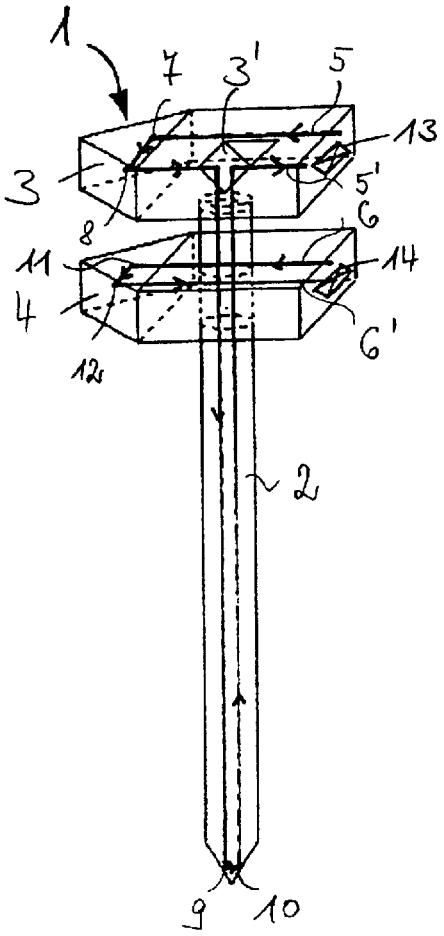
FIG. 1 is a perspective, partially hidden view of the safety device for monitoring safety levels and a filling height according to the invention.

Referring now to the figures of the drawings in detail and first, particularly to FIG. 1 thereof, there is shown a sketch of the principle of a safety device 1 that is disposed in a non-illustrated water-bearing household appliance—for example, a dishwasher. The dishwasher has a container for liquid—preferably, water—that can, as a rinsing container, be filled conventionally through a controllable valve located in a liquid feed line. See, for example, the configuration according to German Patent DE 42 20 718 C2. In such a case, the liquid flows into the container from the liquid feed line with the filling valve open. The safety device 1 in accordance with the invention permits an optical device to be used for monitoring a safety level that avoids overfilling the container with the liquid and, preferably, additionally permits monitoring of a second safety level that prevents the container from being emptied—for example, due to a leak at the bottom of the container. Apart from monitoring the double safety level, the safety device 1 also effects detection of the filling level in addition to monitoring at least one prescribable filling height.

In accordance with the invention, the safety device 1 is configured as an optical light guidance system—preferably made from transparent material such as plastic or Plexiglas. It has an immersion rod 2, preferably running to a tip at the bottom, of cylindrical shape, and a prismatic reflection member 3 for monitoring the double safety level, and a prismatic reflection member 4 for monitoring a prescribable filling height. Both reflection members 3, 4 are permanently connected to the immersion rod 2, and disposed one below another in the example. One prismatic reflection member 3 is seated at the upper end of the immersion rod 2, while the other prismatic reflection member 4 is located at a slight distance in a parallel fashion therebelow.

Due to the form with an immersion rod, the safety device 1 can be immersed in the vertical direction in the liquid of the washing container, for example, like a conventional filling level indicating pin. In such a case, the light guidance system is connected to the container at a plurality of contact sites, for example, by the tip of the immersion rod 2 at the bottom of the container, as well as by the triangular ends of the reflection members 3, 4 at a container wall.

For the purpose of monitoring the double safety level, a light beam 5—preferably an infrared beam—is fed to the reflection member 3 and reflected by the prismatic shape at a plurality of sites 7, 8 such that it strikes a prismatic member 3', disposed in the reflection member 3, which directs the incoming light beam into the immersion rod 2. The deflected light beam runs in the vertical direction to the bottom of the immersion rod 2, is reflected there at sites 9, 10, and is directed back to the prismatic member 3'. The prismatic member 3' then deflects the reflected light beam 5' further such that it leaves the reflection member 3 again in the opposite direction to the light beam 5 fed in. To couple the light beam 5 into the light guidance system, and to couple the reflected light beam 5' out of the light guidance system, an optical sensor 13 is fitted on the prismatic reflection member 3—preferably on a rear side. The optical sensor 13 includes, for example, a photodiode for transmitting the light beam 5, and a phototransistor for receiving the light beam 5'. The infrared beam is coupled in and out at least approximately in the horizontal direction.

Taking account of the differing refractive index of air and water, the detection of the filling level is based on the reflection in the optical light guidance system of the laser beam 5 fed in. Upon contact of the optical light guidance system with the water at one of the reflecting sites 7, 8, the reflection response in the reflection member 3 changes, and the light beam is, for example, interrupted. Consequently, the upper reflection member 3, which is disposed approximately at the height of the maximum permitted filling level in the container, monitors the safety level for overfilling. An electronic evaluation device AU (see FIG. 2) coupled to the light guidance system receives a monitoring signal triggered by the sensor 13, and evaluates the signal. If the light beam has been interrupted, the evaluation device detects the fault and initiates at least one safety measure that reliably prevents overfilling of the container.

Correspondingly, the upper reflection member 3 monitors the safety level additionally for emptying—for example, because of leakage of the container at the bottom—by virtue of the fact that, because of the differing refractive index of air and water, the reflection response changes at one of the reflecting sites 9, 10 at the bottom of the immersion rod 2, and the light beam is interrupted again. The change in the reflection response leads, in the sensor 13, to triggering of a monitoring signal that is transmitted to the electronic evaluation device for evaluation.

For additional monitoring of a specific filling height, a light beam 6—likewise preferably an infrared beam—is fed to the reflection member 4 and reflected by the prismatic shape at a plurality of sites 11, 12 such that it leaves the reflection member 4 again in the opposite direction to the light beam 6 fed in. An optical sensor 14 is likewise fitted on the prismatic reflection member 4—preferably on a rear side—to couple the light beam 6 into the light guidance system and to couple the reflected light beam 6' out of the light guidance system. The optical sensor 14 has, for example, a photodiode for transmitting the light beam 6, and a phototransistor for receiving the light beam 6'. The infrared beam is coupled in and out at least approximately in the horizontal direction. The detection of the filling level and of the individual filling heights to be monitored is based, in turn, on the principle of the reflection, in the optical light guidance system, of the light beam 6 fed in, taking account of the refractive indexes of water and air. Upon contact of the reflection member 4 with the water at one of the reflecting sites 11, 12, there is a change in the reflection response in the reflection member 4, and the infrared beam is interrupted. Consequently, the lower reflection member 4, which is disposed on the immersion rod 2 approximately at the height of the filling level to be monitored in the container, monitors the individual filling height. In the case of interruption of the light beam, the electronic evaluation device coupled to the light guidance system receives a monitoring signal triggered by the sensor 14, and evaluates the signal. If the evaluation device detects that the desired height of fill has been reached, it initiates at least one safety measure that avoids further filling of the container. The double safety level and the prescribable filling height can be advantageously monitored separately from one another by one and the same safety device, which according to the invention is an optical light guidance system. Mechanical components and the defects associated therewith are eliminated.

Figure 2:
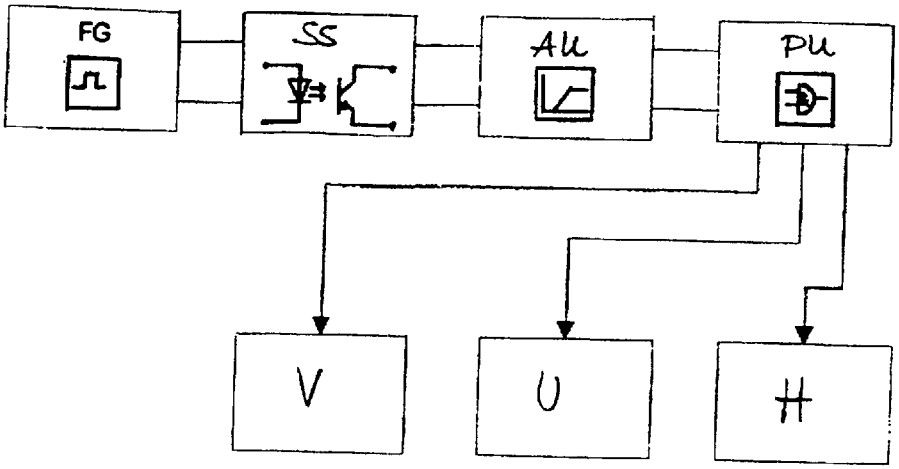
FIG. 2 is a block circuit diagram of the devices for carrying out the level monitoring using the optical light guidance system as safety device according to the invention.

FIG. 2 is a block diagram of the principle, with devices for carrying out the monitoring of the safety level and, if appropriate, of the filling height in conjunction with the use of the optical light guidance system in accordance with FIG. 1 as safety device in the water-bearing household appliance. The devices include a function generator FG, an electronic sensor SS, an evaluation device AU, and a microprocessor PU, of the control signals for components of the household appliance—in the present case, of a dishwasher—such as a valve V for filing the washing container, a suds pump U for pumping the liquid from the container, and a master switch H for switching the household appliance on and off. The function generator FG generates a clocked input signal and feeds it to the downstream sensor SS that, in accordance with the statements relating to FIG. 1, has a photodiode on the input side and a phototransistor on the output side. If the evaluation device AU downstream of the sensor SS receives, from the phototransistor, a signal that corresponds to the input signal coupled in, it detects that there is no variation in the reflection response in the light guidance system, and that, therefore, no monitoring signal has been generated. The evaluation device AU and function generator FG preferably form together an electronic circuit for level monitoring. However, if the sensor SS supplies a signal deviating from the input signal, the evaluation device AU interprets such a signal as a monitoring signal and generates a control signal for the microprocessor PU to trigger at least one safety measure. The double safety level is checked through one electronic sensor on the reflection member of the optical light guidance system that provides an appropriate output signal, while the checking of the filling height of the electronic sensor at the other reflection member of the optical light guidance system makes an appropriate output signal available for evaluation and reaction. Upon detection of one or other safety level, preferred safety measures lie in that, given the presence of the appropriate control signal, the microprocessor PU causes the valve V to close in order to stop further filling of the washing container and, thereby, to counteract overfilling, or to switch off the master switch H to avoid further filling and, thus, to indicate the defect of a component—for example, leakage of the bottom of the container. One safety measure upon detection of the filling height lies in switching on the lye pump U, which exhausts liquid from the container.

When it is desired to detect and monitor a plurality of filling heights, a plurality of optical light guidance systems composed of immersion rods with associated reflection members can be disposed in the container. The electronic evaluation is performed in the same way as described above with the aid of the block diagram.

We claim:

1. A water-bearing household appliance, comprising:

a valve;

a liquid feed line connected to said valve;

a container connected to said liquid feed line, said container filled with liquid through said valve and said liquid feed line to a liquid filling level;

a safety device connected to said container and having:

a double safety level; and an optical light guidance system having a first member defining at least one first reflecting site and a second member defining at least one second reflecting site; and said light guidance system monitoring said double safety level in said container by a change in a reflection response of the light beam at one of said at least one first and second reflecting sites.

2. The water-bearing household appliance according to claim 1, wherein said first member is a prismatic reflection member and said second member is an immersion rod.

3. The water-bearing household appliance according to claim 2, wherein:

said immersion rod is optically connected to said prismatic reflection member; and said prismatic reflection member has a prismatic member through which the light beam is deflected into said immersion rod and back from said immersion rod to said reflection member.

4. The water-bearing household appliance according to claim 1, wherein said light guidance system has a prismatic reflection member for monitoring a filling height in said container.

5. The water-bearing household appliance according to claim 2, wherein said prismatic reflection member is permanently connected to said immersion rod.

6. The water-bearing household appliance according to claim 2, including an optical sensor disposed on said prismatic reflection member, said optical sensor coupling the light beam into said light guidance system and out of said light guidance system.

7. The water-bearing household appliance according to claim 2, wherein:

said at least one prismatic reflection member is a plurality of reflection members; and an optical sensor is disposed on each of said reflection members, said optical sensor coupling the light beam into said light guidance system and out of said light guidance system.

8. The water-bearing household appliance according to claim 1, wherein:

said light guidance system generates at least one monitoring signal; and an electronic evaluation device is coupled to said light guidance system and initiates at least one safety measure upon reception of said at least one monitoring signal from said light guidance system.

9. The water-bearing household appliance according to claim 8, wherein:

said electronic evaluation device is coupled to said valve; and said at least one safety measure is a switching off of said valve.

10. The water-bearing household appliance according to claim 8, including a suds pump connected to said container for exhausting liquid from said container, said at least one safety measure being a switching on of said suds pump to exhaust liquid from said container.

11. The water-bearing household appliance according to claim 8, including a master switch, said at least one safety measure being a switching off of said master switch.

12. The water-bearing household appliance according to claim 1, wherein said light guidance system is of a transparent material.

13. The water-bearing household appliance according to claim 1, wherein:

said container has a plurality of contact sites; and said light guidance system is connected to at least one of said contact sites.

14. The water-bearing household appliance according to claim 13, wherein said light guidance system is connected to each of said contact sites.

15. A water-bearing household appliance, comprising:

a valve;

a liquid feed line connected to said valve;

a container connected to said liquid feed line, said container filled with liquid through said valve and said liquid feed line to a liquid filling level;

a safety device connected to said container and having:

a double safety level; and an optical light guidance system having a first member defining at least one first reflecting site and a second member defining at least one second reflecting site; and said light guidance system being programmed for monitoring said double safety level in said container by a change in a reflection response of the light beam at one of said at least one first and second reflecting sites.

16. In a water-bearing household appliance with a liquid container filled through a valve disposed in a liquid feed line, a safety device comprising:

a double safety level; and an optical light guidance system having a first member defining at least one first reflecting site and a second member defining at least one second reflecting site, said light guidance systems:

monitoring said double safety level in said container by a change in a reflection response of the light beam at one of said at least one first and second reflecting sites.

* * * * *